US008807468B2

(12) United States Patent
Neunzert

(10) Patent No.: US 8,807,468 B2
(45) Date of Patent: Aug. 19, 2014

(54) CONTROLLED FEED-RATE SHREDDING

(75) Inventor: Michael G. Neunzert, Tigard, OR (US)

(73) Assignee: SSI Shredding Systems, Inc., Wilsonville, OR (US)

( * ) Notice: Subject to any disclaimer, the term of this patent is extended or adjusted under 35 U.S.C. 154(b) by 425 days.

(21) Appl. No.: 13/339,120

(22) Filed: Dec. 28, 2011

(65) Prior Publication Data

US 2012/0175443 A1 Jul. 12, 2012

Related U.S. Application Data

(63) Continuation of application No. 61/430,975, filed on Jan. 8, 2011.

(51) Int. Cl.

| | |
|---|---|
| ***B02C 25/00*** | (2006.01) |
| ***B02C 18/14*** | (2006.01) |
| *B02C 18/16* | (2006.01) |

(52) U.S. Cl.

CPC ..... *B02C 18/142* (2013.01); *B02C 2018/164* (2013.01); *B02C 25/00* (2013.01)

USPC ..... 241/36; 241/236

(58) Field of Classification Search

USPC ..... 241/36, 236

See application file for complete search history.

(56) References Cited

U.S. PATENT DOCUMENTS

| | | | | |
|---|---|---|---|---|
| 2,682,810 | A | 7/1954 | Jones | |
| 4,377,259 | A * | 3/1983 | Areaux et al. | 241/73 |
| 4,586,146 | A | 4/1986 | Dumbeck et al. | |
| 5,199,666 | A | 4/1993 | Williams | |
| 5,285,973 | A | 2/1994 | Goforth et al. | |
| 5,494,229 | A * | 2/1996 | Rokos et al. | 241/15 |
| 7,568,644 | B1 | 8/2009 | Kodis | |
| 8,157,014 | B2 * | 4/2012 | Hariharan et al. | 166/357 |
| 2002/0063178 | A1 | 5/2002 | Strutz et al. | |

* cited by examiner

*Primary Examiner* — Mark Rosenbaum
(74) *Attorney, Agent, or Firm* — Jon M. Dickinson, P.C.

(57) ABSTRACT

A method, and method-implementing system structure, for metering the flow of material through the shredding zone in a rotary shear shredder, which zone is defined, at least in part, by confrontingly rotating knives that are carried on a pair of adjacent, power-driven, nominally matched-motion counter-rotating shafts. The method includes holding the speed and rotational direction of one of the shafts essentially constant while selectively varying, in a manner variably differentiating the relative rotational motions of the two shafts, the speed, and under certain circumstances also the direction, of rotation solely of the other shaft.

2 Claims, 1 Drawing Sheet

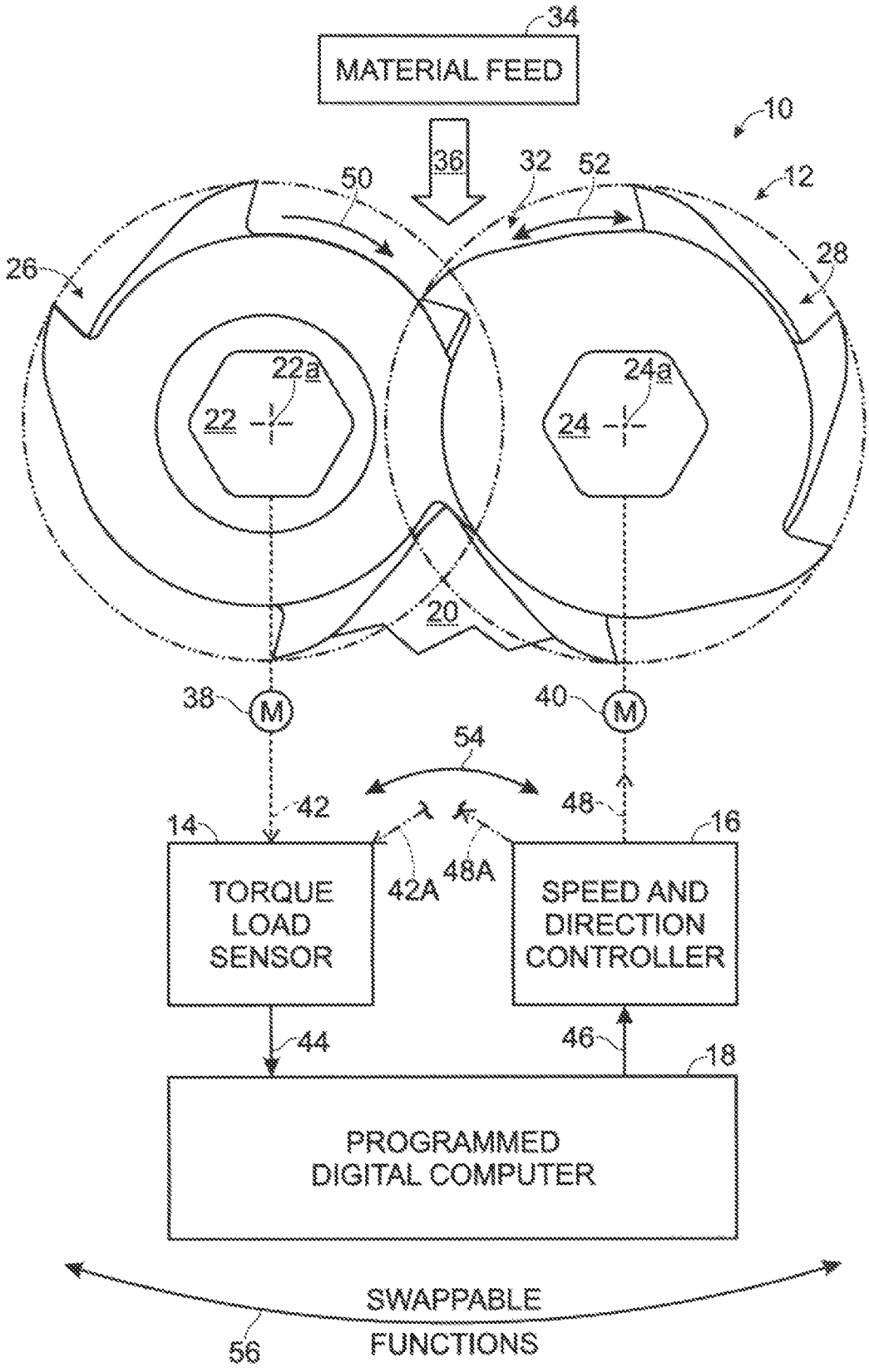
34
MATERIAL FEED
10
36
32
52
12
50
26
28
22a
24a
22
24
20
38
M
40
M
54
42
48
14
16
42A
48A
TORQUE LOAD SENSOR
SPEED AND DIRECTION CONTROLLER
44
46
18
PROGRAMMED DIGITAL COMPUTER
SWAPPABLE FUNCTIONS
56

CONTROLLED FEED-RATE SHREDDING

CROSS REFERENCE TO RELATED APPLICATION

This application claims filing-date priority to U.S. Provisional Patent Application Ser. No. 61/430,975, filed Jan. 8, 2011, for "Controlled Feed-Rate Shredding", the entire disclosure content in which is hereby incorporated herein by reference.

BACKGROUND AND SUMMARY OF THE INVENTION

This invention pertains to an improvement in rotary shear shredding, and specifically to an improved system, and to an associated, improved methodology, based upon controlled-feed-rate shredding of material in a rotary shear shredder. More particularly, it concerns such a system and methodology which involve metering the flow of material through the shredding (shearing) zone in such a shredder by variably differentiating, through the making of single-shaft motion adjustments, the relative rotational motions of the usual, two, power-driven, conventionally matched-motion counter-rotating, knife-carrying shafts which, with their respectively carried, circularly-overlapping-sweep knives, define this shredding zone. The phrase of "circularly-overlapping-sweep" associated with these knives refers to the usual shearing circular overlap of the travel circles described by the outer extremities of the knives in the two sets of "shear-overlapping" knives carried by the shafts as the knives and shafts are viewed along their rotational axes.

The terminology "matched-motion", and the like, herein is intended to refer to the usual matching-speed counter-rotations of the two shaft. The terminology "variably differentiating" the relative rotational motions of such two shafts, and the like, is intended to refer to the making of single-shaft-only relative motion (rotational speed and/or rotational direction) adjustments.

Material-flow metering, in accordance with both a preferred embodiment of the invention system, and a preferred practice of the invention with that system, is carried out effectively throughout the durations of shredding operations, and involves holding the speed and rotational direction of one of the two (two shafts being illustrated herein in the preferred embodiment) shredder shafts, which is variously called herein the selected "main", or the selected "method-designated main", shaft, essentially constant while selectively and differentially varying, in relation to the monitored shredding torque load exerted on that "main" shaft, the speed, and under certain circumstances also the direction, of rotation of the other which is variously referred to herein as the selected "controlled", or "metering", or the selected "method-designated controlled", shaft. This differential relative-shaft-motion control (the above-mentioned concept of variable differentiation) is implemented systemically preferably under the influence of an appropriately programmed digital computer so as to achieve, as much as possible, a continuously steady, non-jamming material throughput through the shredder's shredding zone.

The invention proposes both preferred and best-mode, and several modified, systemic embodiments and manners of methodologic practice, each suited to different, specific shredding application needs.

Common to all embodiments and methodologic practices of the invention is the mentioned, single-shaft-only, differential relative-motion (variable differentiation) shaft control—a feature, always associated with the selected "controlled" (or "metering") shaft, which feature is believed to offer unique and distinctly effective improvements, relative to background-past problems, in the operations of rotary shear shredders.

Heretofore, rotary shear shredders generally shred material which is supplied as input via a gravity feed hopper. Typically a shredder's associated hopper is loaded from a conveyor, a dumper or directly by hand. Different types of process material, and the just-mentioned, typical infeeding methods, directly impact the torque load exerted on the power-driven, rotating-knife-carrying shredder shafts.

These two factors—feed style and material type—cause significant shredder torque demand variations that typically lead to expensive design over-sizing of shredder drives, and to costly revising of shredder-cutting geometry, such that the toughest material to be processed can confidently and correctly be shredded.

As those skilled in the relevant art well know, some process materials are essentially unable to be shredded due their propensity to self-feed. Examples of this are baled aluminum, and stringy materials such as tarps and so-called super-sacks.

As suggested above, the present invention, in each of its herein-described embodiments and manners of operation, all of which feature the above, generally described differential relative-motion shaft control, satisfactorily, and with definitive improvements, takes into account these prior art shear-shredding considerations.

According to a preferred and best-mode embodiment of the invention, what the invention proposes, generally speaking, is a system for the controlled-feed-rate shredding of material in a rotary shear shredder, including:

(1) a pair of spaced, laterally adjacent, nominally matched-motion counter-rotating, power-driven shredder shafts, including, under all shredding operating conditions, a selected main shaft and a selected controlled, or metering, shaft, these shafts carrying sets of confrontingly rotating knives which, with their associated shafts, define between them a shredding zone into which material to be shredded is fed, (2) a pair of drive motors, each drivingly connected to a different one of the two shafts, each motor being selectively, and individually, speed-variable and rotation-direction reversible, and (3) operatively associated with the shafts and motors, material feed-rate control structure, including (a) a torque load sensor at all times operatively connected to the drive motor which is drivingly connected to the selected main shaft, operable effectively to monitor, continuously during shredding, the torque load experienced by that shaft, (b) a speed and direction controller at all times operatively connected to the drive motor which is drivingly connected to the selected controlled, or metering, shaft, operable to change the rotational speed and the rotational direction of that shaft, and (c) an algorithmically programmed digital computer operatively connected both to the sensor and to the controller, operable, based upon the selected main shaft torque load monitored by the sensor, and employing the controller in relation to the drive motor which is drivingly connected to the selected controlled shaft, to control selectively, in a manner variably differentiating the relative rotational motions of the two shafts, the rotational speed and, if needed, the rotational direction of the selected controlled shaft in a way effective to achieve a desired, appropriate and controlled, material-shredding feed-rate through the shredding zone.

In this preferred and best-mode embodiment of the invention, the two shredder shafts and their power-drive motors, are essentially identically sized, and possess essentially the same operational torque-load capacities. Both have the same speed ranges, peak transmitted torques, and overall knife sizes and shapes. The selected "main shaft" runs always at full speed, and with its carried knives does the majority of the shredding. The selected "controlled, or metering, shaft" controls the "main shaft" load by varying its speed, and if needed, its rotational direction. The main shaft torque is monitored, as mentioned, and this monitored torque is used to control the speed and rotating direction of the metering shaft.

Embodiment variations include (1) periodically swapping the roles of the two shafts in such a manner that each shaft becomes, variously and alternately, in one interval of time the selected main shaft, and in another, alternate interval of time the selected controlled (or metering) shaft, and (2) implementing the invention features in a shredder wherein the two shafts and their associated drive motors are differentiated in sizes and working capacities, and wherein the smaller and lower-capacity shaft and associated drive motor always function in the selected, controlled/metering mode of operation.

From one methodologic point of view, and still generally speaking, the invention offers a method for metering the flow of material through the shredding zone in a rotary shear shredder, which zone is defined by confrontingly rotating knives that are carried on a pair of adjacent, power-driven, nominally matched-motion counter-rotating shafts, including holding the speed and rotational direction of one of the shafts essentially constant while selectively changing, in a manner variably differentiating the relative rotational motions of the two shafts, the speed, and under certain circumstances also the direction, of rotation solely of the other shaft.

From another methodologic perspective, the invention proposes a material-feed-rate method for the controlled, through-flow shredding of material fed into the shredding zone in a rotary shear shredder, which zone is defined by confrontingly rotating knives carried on a pair of elongate and parallel, adjacent, nominally counter-rotating, power-driven shafts including, under all operating conditions, a selected, method-designated main shaft and a selected, method-designated controlled shaft. The method steps include (a) monitoring, during shredding, the torque load exerted on the method-designated main shaft, and (b) in response to such monitoring, and in relation to the respective operations of the two shafts in the pair, selectively varying at least one of (1) the speed and (2) the rotational direction of the method-designated controlled shaft in a manner intended to achieve desired, appropriate and controlled, material-feed-rate through the shredding zone.

These and other various features and advantages of the invention will become more fully apparent as the detailed description of it presented below is read in conjunction with the accompanying drawing.

DESCRIPTION OF THE DRAWING

The invention, in several of its systemic and methodological forms (as will be discussed below) is illustrated for drawing-economy reasons herein, by a single drawing FIGURE which presents it schematically, and partially fragmentarily, in a manner designed to illustrate both preferred and best-mode, and several modified, embodiments of it—both methodologic and structural.

DETAILED DESCRIPTION OF THE INVENTION

Turning now to the drawing, and describing from one systemic and methodologic point of view using this drawing for both of these aspects of the present invention, what is shown therein, indicated generally at 10 is a preferred and best-mode form of a rotary shear-shredding system, and an associated methodology, constructed in accordance with the invention for the controlled feed-rate shredding of material fed into the shredding zone in a rotary shear shredder. System 10, described now chiefly, and immediately below, from a systemic perspective, and recognizing that this systemic-perspective description also "effectively" describes the associated companion methodology (also designated 10 herein), includes, fragmentarily and somewhat schematically illustrated, an otherwise conventional ("otherwise", or other, than as this shredder is associated combinationally with other collaborative structure now to be described) two-shaft, rotary shear shredder 12, a torque load sensor 14, represented schematically by a functionally and structurally matchingly text-labeled block, a speed and direction controller 16, represented schematically by another functionally and structurally matchingly text-labeled block, and an appropriately algorithmically programmed digital computer, represented schematically by yet another functionally and structurally matchingly text-labeled block 18. Sensor 14, controller 16, and computer 18 collectively constitute herein a material feed-rate control structure—the overall operation of which will be described shortly.

Sensor 14, controller 16, and computer 18 are each preferably conventional in construction, and may be made in a number of different, well-known ways that are familiar to those generally skilled in the art. For these reasons, these three components in the system are illustrated herein only in the non-detailed, just-mentioned block forms which appear as simple outlines in the drawing FIGURE. From the systemic and methodologic operational descriptions which are presented below respecting how system 10, and in it these three, block-represented components, function during shredding, the respective natures of these three conventional components will be readily apparent to those skilled in the art.

Shredder 12 includes a frame, a fragmentary portion of which appears at 20, and on which frame are appropriately journaled for rotation the earlier above-generally-mentioned, two, operational shredder shafts, shown at 22, 24. Shafts 22, 24 are elongate and disposed in parallel, spaced, lateral adjacency in the shredder, and are specifically supported on frame 20 for rotation about their respective longitudinal axes designated 22*a*, 24*a*. These two shafts are also referred to herein as nominally matched-motion, counter-rotating, power-driven shredder shafts. More will be said shortly about shaft rotational motion. With respect to the preferred invention form now being described, and as will be explained, two principal modes of shredding operation will be implemented. In one of these modes, or manners, of operation, shaft 22 always functions as the above described, selected "main", or "method-designated main", shaft, and shaft 24 always functions as the selected "controlled", or "metering", or "method-designated controlled" shaft. In the other mode, or manner, of operation, these shaft-selected roles that are played by the two shafts alternate under the control of computer 18. Intervals of such alteration are freely user selectable, and a typical alteration interval might be about 30-seconds.

Establishment of all aspects of these operating modes is selectively, and conventionally, implementable by operation of computer 18.

Carried in an anchored fashion, conventionally and respectively on shafts 22, 24, are essentially functionally and structurally matched (as mentioned above), conventional sets 26, 28 of appropriately distributed and organized (along the shafts' long axes), confrontingly rotating knives. The rotating knives in sets 26, 28, along with their carrying shafts 22, 24, respectively, collectively define a shredding zone 32 into which material which is to be shredded is fed, downwardly in the drawing FIGURE, as is illustrated by a text-labeled block 34 and a downwardly pointing, broad arrow 36.

Two, large, overlapping, dash-double-dot circles, not specifically labeled, illustrate the paths, referred to above as the circularly overlapping sweeps, traveled by the outer extremities of the knives in sets 26, 28.

Drivingly connected, respectively, to shafts 22, 24 are conventional, matched-size and capability, electric, or hydraulic, drive motors 38, 40.

In a first way of thinking about the construction—the preferred construction—of shredder 12 as it is now being described, and as has been mentioned earlier herein, the shafts, the rotating knife sets, and the drive motors are fully matched structurally and functionally, with the same operating torque capacities. The motors are each selectively rotationally-speed-adjustable, and rotationally-directionally-reversible, and in the two, soon to be further described, somewhat different manners of operating shredder 12, as so configured and just described, either one, or each, of the motors (depending on the chosen operating manner) is in fact rotationally-speed-varied, and occasionally rotationally-directionally reversed, under the control of computer 18. These two operating manners will be discussed fully shortly.

As can be seen in the drawing FIGURE, within system 10, the torque load sensor, the speed and direction controller, and the programmed digital computer are operatively interconnected within the control-structure realm which they form, and in the form of this control structure, and within system 10, are operatively connected effectively to each of motors 38, 40, and through these motors, to the rotating-knife-carrying shafts 22, 24, respectively.

The operative interconnection and the other connections just mentioned, are specifically illustrated, as will now be particularly described, in a manner focused on implementing one preferred-invention-form operating mode for system 10—i.e., one of the two operating "manners" just mentioned above. More specifically: (1) a dashed, downwardly pointing, arrowheaded line 42 operatively connects motor 38 (and thus also effectively shaft 22) with the torque load sensor, and participates in the collection of instantaneous torque-load information from this shaft and motor; (2) a solid, downwardly pointing, arrowheaded line 44 operatively connects, and feeds shaft-22 monitored torque information from, the torque load sensor to computer 18; another solid, and in this case upwardly pointing, arrowheaded line 46 supplies monitored-torque control information from computer 18 to speed and direction controller 16; and finally, a dashed, upwardly pointing, arrowheaded line 48 furnishes, as appropriate, speed and/or speed and direction control instructions from computer 18 to motor 40 and shaft 24.

This specifically pictured control arrangement is one in which shaft 22 functions always as the selected, method-designated main shaft, and shaft 24 functions always as the selected, method-designated controlled, or metering, shaft In this operational configuration of system 10, motors 38, 40 drive shafts 22, 24, respectively, and nominally (i.e., before any shaft-operational differentiation takes place in accordance with the invention-offered practice of flow metering by variably differentiating the relative rotational motions of the two shafts) in counter-rotation and at the same rotational speed. Such counter rotation is illustrated in the drawing by two, curved, arrow-headed lines 50 (arrowheaded at a single end), 52 (arrowheaded at its two, opposite ends).

Line 50, with its single, clockwise-directed arrowhead, represents an intended, steady-speed, clockwise rotation for shaft 22 and for its carried rotating knives in knife set 26 at a user selected, and computer controlled, speed. This steady-speed rotational condition will remain unchanged during shredding in the now-being discussed "one", or "first", manner of systemic operation, except in the unlikely event that something (such as a charge of material to be shredded) unexpectedly and seriously clogs the shredding zone to create an emergency condition requiring stoppage and reversal of shaft 22. In this "one" manner of operation, and as has been mentioned, shaft 22 always functions as the "main", or "method-designated main", shaft.

Double-arrow-headed line 52 indicates that, in the "one"/"first" operating manner which is now being described, motor 40 and shaft 24 may be selectively speed changed, and even reversed in rotational direction, as required in order to effect controlled material feed through shredding zone 32 in accordance with the central, unique practice of the invention involving material-flow metering by variably differentiating the relative rotational motions of the two shafts. Nominally, shaft 24 operates at the same, but counter-clockwise, rotational speed set for shaft 22.

Further describing the systemic and methodologic operation and performance of system 10 (as the illustrated features of this system and methodology have just been discussed in their preferred forms, and in relation to the first-discussed, preferred-form mode of operation of the invention), main shaft 22, and its carried, rotating knives, continuously turn in the clockwise direction indicated by arrowheaded line 50. Under the influence of computer 18, torque load sensor 14, through its operative connection with motor 38, continuously monitors the shredding torque load exerted on main shaft 22, and in accordance with whatever is the current, operational, algorithmic programming that is active in computer 18, feeds, for systemic and methodologic reaction (in accordance with the invention), torque-load information to the computer in a manner causing the computer to transmit, through speed and direction controller 16, operating speed, and under certain circumstances direction-of-rotation-reversal, control instructions to motor 40, and thus to controlled shaft 24. A consequence of this behavior is that there results a controlled rate of feed of material to be shredded through shredding zone 32—a feed rate which is controlled in a manner preventing a material jamming condition, and offering certain other advantages which will be explained below herein. The speed and rotational-direction control thus exerted on controlled shaft 24 acts in the manner which has been described herein as variably differentiating the relative rotational motion of the two shafts in a way effective to achieve a desired, appropriate and controlled, material-shredding feed-rate through the shredding zone.

Algorithms designed for implementing, via computer 18, specific, user-chosen approaches toward rotational speed and direction control of a "selected" controlled shaft in a rotary shear shredder, according to the invention, are numerous, are easily tailorable to handle different, specific shredding applications, may include algorithms that automatically adapt to shredding conditions and to material being processed (without manual intervention), and are readily constructible by those skilled in the programming arts for incorporation in computer 18.

Presented now immediately below, in narrative form, is an example of one such useful algorithm, very straight-forward in its features, and within whose architecture systemic and methodologic operation of shredder 12 is broken down into, i.e., handled in, several distinct "operating phases" (described below) based on the monitored and detected, instantaneous material-shredding torque load exerted on the selected main shaft (22 in the illustration now being discussed):

(1) Normal shredder operation—In the main shaft torque-load range from no load to about 75% of full torque load, the metering shaft speed is set to maximum forward speed (both shafts counter-rotating at same speed). Both shafts pull material into the shredding zone.

(2) Transitional operation—From a main shaft torque load of about 75% to one of approximately 100%, the speed of the metering shaft is decreased progressively from full speed forward (counter-rotating) at 75% main shaft torque load, to stationary at 100% main shaft torque load. In this zone the amount of material entering the shredding zone is reduced as the main shaft torque load increases.

(3) Overload operation—Above a main shaft torque load of 100%, the metering shaft reverses so that the two shafts are rotating in the same direction, an action which has the effect of removing material from the shredding zone. The reversal speed would increase at higher levels of main shaft torque so as rapidly to remove material from the shredding zone and prevent a potential shredder-jamming overload.

[As an important note regarding this algorithmically controlled, "Overload operation" phase of operation, it turns out that being able to change from forward to reverse rotational directions for the metered shaft in less than about 2-seconds can be critical, and the system and methodology of the present invention readily enable this to happen.]

(4) Reversal—If for some reason the Overload operation does not successfully control an intolerable overload condition on the main shaft, or if there is an unshreddables object in the shredding zone, the computer would implement, effectively, a brief, two-shaft reversal. In this situation, with the controlled shaft still in a reverse-rotation condition, the main shaft would stop, and then reverse for a few seconds. At that point, preferably one of the categories (phases 1, 2 or 3) of non-reversal operation would resume, or as an alternative, the system could be "switched" into a brief condition, for perhaps only a few seconds, wherein, in effect, what has just been the controlled/metering shaft would become the main shaft, and what has just been the main shaft would become the controlled/metering shaft. How the system and methodology of the invention are structured to permit this will be explained shortly Response quickness to main-shaft torque-load changes is very important, inasmuch as shredder main-shaft torque loading can vary rapidly from nearly zero up to overload values on a time scale of less than one, to just a few, second(s). As a result, shredder 12 operation will typically be continuously moving through, and rapidly so, most of the operational phases mentioned above as the main-shaft torque load rapidly varies. Computer 18 assures rapid response to such variations, and because of the fact that response in almost all cases involves simply relationally varying the operating speed, and occasionally the rotational direction, of just the metering shaft, the invention furnishes an extremely efficient way to manage, and maintain, a comfortably controlled feed rate of material through a rotary shear shredder's shredding zone. In most instances, material shredding, per se, will continue unabated because of the continuity of rotational operation of the selected main shredder shaft.

Completing now a description of what is shown in the drawing FIGURE, and using this completion as a springboard for describing the "second one" of the two, earlier-mentioned, principal modes of shredding operation that are implementable in and by system and methodology 10 in their associated preferred forms, two, solid, double-arrowheaded curved lines 54, 56 schematically illustrate this second, principal operational mode. This second mode specifically involves a practice of regularly switching, i.e., swapping, the operational roles, or functions, performed in the shredder by shafts 22, 24 and their respectively associated drive motors 38, 40. Line 56 is, accordingly, labeled "Swappable Functions". Line 54 is unlabeled.

Associated with this second-mode function-swapping practice are two, fragmentary, dash-double-dot, arrowheaded lines 42A, 48A which represent essentially the same kinds of connections previously described for lines 42, 48, respectively, but switched (under the control of computer 18) in such a manner that the torque load sensor monitors, effectively through motor 40, the torque load exerted shaft 24, and the speed and direction controller supplies rotational speed and operational rotational directional information from computer 18 to shaft 22 via motor 38.

An algorithm like that described in narrative form above may also be employed in this operating mode of the invention, with, of course, an addition instructing computer 18 to perform a switching/swapping function, for example, at regular intervals, such as about every 30-seconds. Such function swapping evenizes wear on all of the motion components in system 10.

Considering now a further useful embodiment of the invention, and recalling that main-shaft and metering-shaft drive-motor horsepower, and related matters, in shredder 12, as described so far herein in its preferred embodiment, has been effectively "symmetrical" in terms of the sizes and working capacities of shafts 22, 24, drive motors 38, 40 and knife-set configurations 26, 28, there is a potential for a significant, overall shredder cost reduction by making the metering and main shafts, their respective drive motors, and knife hardware, "bilaterally" size-different. Trial experience to date has shown that the metering shaft typically needs to turn much more slowly than does the main shaft, and must be speed-controlled in both forward and reverse directions. The metering shaft does not appear to need the same torque capability as does the main shaft, but does need significant torque capacity to control infed material. As a result, it may be that the metering shaft and associated drive-motor horsepower and speed can be reduced relative to those of the main shaft and its associated drive-motor, since its function is more to control the feed rate than to power the function of shredding. This could dramatically reduce the cost of a shredder's drive system and operational controls. It eliminates the sure need for swapping the main and metered shaft functions, but, of course, such swapping could be perfectly acceptable in certain instances.

Thus, this further embodiment of the invention should be viewed as also being illustrated by the single drawing FIGURE, with the understanding that the motion components associated with shaft 24 are reduced in size, and that, under substantially all shredding operating conditions, the functional roles of shafts 22, 24 do not change, with shaft 22 is always being the "selected" main shaft, and shaft 24 always being the "selected" controlled/metering shaft.

Controlled feed-rate shredding—the focus of the present invention—involves a method, and an associated system structure, for controlling a shredder in a way, utilizing flow-rate metering, that limits the amount of "now-being-shredded" process material to a metered flow-quantity that a rotary shear shredder has the "sure" ability to shred. The central method of the invention may also be described as one involving holding the speed and rotational direction of one of the usually present two shafts essentially constant while selectively varying, in a manner variably differentiating the relative rotational motions of these two shafts, the speed, and under certain circumstances also the direction, of rotation solely of the other shaft.

Controlled feed-rate shredding can be implemented on a two-shaft, or a four-shaft (not specifically illustrated in the drawing), rotary shear shredder driven by independent drive motors for each of the shredder shafts. As has been mentioned, practice of the invention can be implemented within either a direct electric drive rotary shear shredder with appropriately deployed variable speed and direction controls, or an hydraulic drive rotary shear shredder also with appropriately deployed variable speed and direction controls.

In the practice of the invention, as above described, the selected "main" shaft load is torque-level monitored effectively through the operation of an operatively interconnected torque load sensor and a programmable digital computer using appropriate algorithms to establish a response-reaction for the selected "metering" shaft. Thus the rotational speed, and if necessary the rotational direction, of the metering shaft are very tightly controlled based on the torque being applied to (exerted on) the main shaft. By slowing or even reversing the metering shaft, the amount of material being introduced into the shearing/shredding zone is limited to what the main shaft and its knives can confidently and properly shred.

An important advantage thus offered by the invention is the ability to process materials that would otherwise overload (over feed) a shredder and create the need for a reversal (where both shafts stop, reverse, and turn in a way that moves material out of the shredding zone). Reversals of this nature bring production to a stop, and cause problems for machines upstream and downstream of the affected shredder due to interrupted process-material flow.

Another benefit of controlled feed-rate shredding according to the invention is that the particle size of shredded material is typically quite small since the material is metered into the shredding zone between the driven shafts and their carried rotating knives under a condition with the designated main shaft preferably, and substantially always, turning at full speed.

Thus there have been illustrated and described herein, in preferred and alternative forms and modalities of practice, significant facets of a unique and highly effectively improved rotary-shear-shredding methodology and associated systemic structure. Foundationally, these facets of the invention rest upon carefully, continuously, and automatically metering the flow of to-be-shredded material through the shredding zone in a rotary shear shredder, which zone is defined, at least in part, by confrontingly rotating shearing/shredding knives that are carried on adjacent, power-driven, and nominally matched-motion counter-rotating shafts, through holding the speed and rotational direction of one of the shafts essentially constant, while selectively varying, in a manner variably differentiating the relative rotational motions of the two shafts, the speed, and under certain circumstances also the direction, of rotation solely of the other shaft. While, as just mentioned, alternative forms and practice modalities, etc., of the invention have so been presented, I appreciate that other variations and modifications are possible, and I intend that all such other variation and modification will be construed to come within the scopes of the below-included claims.

I claim:

1. A system for the controlled-feed-rate shredding of material in a rotary shear shredder comprising a pair of spaced, laterally adjacent, nominally matched-motion counter-rotating, power-driven shredder shafts, including, under all shredding operating conditions, a selected main shaft and a selected controlled shaft, said shafts carrying sets of confrontingly rotating knives which, along with their respective, associated shafts, define between them a shredding zone into which material to be shredded is fed, a pair of drive motors, each drivingly connected to a different one of said shafts, each said motor being selectively, and individually, speed-variable and rotation-direction reversible and operatively associated with said shafts and motors, material feed-rate control structure including (a) a torque load sensor at all times operatively connected to the drive motor which is drivingly connected to said selected main shaft, operable effectively to monitor, continuously during shredding, the torque load experienced by that shaft, (b) a speed and direction controller at all times operatively connected to the drive motor which is drivingly connected to said selected controlled shaft, operable to change the rotational speed and the rotational direction of that shaft, and (c) an algorithmically programmed digital computer operatively connected both to said sensor and to said controller, operable, based upon the selected main shaft torque load monitored by said sensor, and employing said controller in relation to the drive motor which is drivingly connected to said selected controlled shaft, to control selectively, in a manner variably differentiating the relative rotational motions of the two shafts, the rotational speed and, if needed, the rotational direction of said selected controlled shaft in a way effective to achieve a desired, appropriate and controlled, material-shredding feed-rate through the shredding zone.

2. The system of claim 1, wherein said control structure is structurally configured whereby, under the control of said computer, said torque load sensor and said speed and direction controller are selectively switchable in relation to their operative connections to said shafts so as to alternate the selections of the shafts as being a main shaft and a controlled shaft.

* * * * *